US010026367B2

(12) United States Patent
Meng et al.

(10) Patent No.: US 10,026,367 B2
(45) Date of Patent: Jul. 17, 2018

(54) BACKLIGHT ADJUSTMENT METHOD, BACKLIGHT ADJUSTMENT SYSTEM AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Zhiming Meng, Beijing (CN); Weihao Hu, Beijing (CN); Jianming Wang, Beijing (CN); Wengang Su, Beijing (CN); Zongze He, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 64 days.

(21) Appl. No.: 14/501,975

(22) Filed: Sep. 30, 2014

(65) Prior Publication Data

US 2015/0348471 A1 Dec. 3, 2015

(30) Foreign Application Priority Data

May 28, 2014 (CN) ..... 2014 1 0230780

(51) Int. Cl.
*G09G 3/34* (2006.01)
*G09G 3/36* (2006.01)

(52) U.S. Cl.
CPC ..... *G09G 3/3426* (2013.01); *G09G 3/3611* (2013.01); *G09G 2310/0237* (2013.01);
(Continued)

(58) Field of Classification Search
None
See application file for complete search history.

(56) References Cited

U.S. PATENT DOCUMENTS

2009/0135128 A1* 5/2009 Jeon ..... G09G 3/342 345/102
2010/0295767 A1 11/2010 Lee et al.
(Continued)

FOREIGN PATENT DOCUMENTS

CN 1797082 A 7/2006
CN 101086573 A 12/2007
(Continued)

OTHER PUBLICATIONS

1st office action issued in Chinese application No. 201410230780.9 dated Sep. 29, 2015.

*Primary Examiner* — Amr Awad
*Assistant Examiner* — Donna Lui
(74) *Attorney, Agent, or Firm* — Nath, Goldberg & Meyer; Joshua B. Goldberg; Scott H. Blackman

(57) ABSTRACT

The present invention provides a backlight adjustment method, a backlight adjustment system and a display device. The backlight adjustment method comprises: dividing a frame of picture into n image blocks, obtaining the sub-backlight brightness corresponding to each image block, and further comprises: calculating an average backlight brightness corresponding to the frame of the picture on the basis of each sub-backlight brightness, determining whether the sub-backlight brightness needs to be enhanced on the basis of the average backlight brightness, and performing enhancement for the sub-backlight brightness which needs to be enhanced, wherein n is an integer greater than 1. The backlight adjustment method not only solves the problems of reduced brightness for bright picture and poor display effect associated with existing backlight adjustment method, but also reduces the overall display power consumption, increase the image contrast and reduce influence of mura (ripple phenomenon) on the screen.

16 Claims, 3 Drawing Sheets

(52) U.S. Cl.
CPC ..... *G09G 2320/0233* (2013.01); *G09G 2320/066* (2013.01); *G09G 2320/0646* (2013.01); *G09G 2330/021* (2013.01); *G09G 2330/023* (2013.01); *G09G 2360/16* (2013.01)

(56) References Cited

U.S. PATENT DOCUMENTS

| | | | | |
|---|---|---|---|---|
| 2012/0038694 | A1* | 2/2012 | Nakanishi ..... | G09G 3/3426 345/694 |
| 2012/0281028 | A1* | 11/2012 | Orlick ..... | G09G 3/3426 345/690 |
| 2014/0160180 | A1* | 6/2014 | Oda ..... | G09G 3/3426 345/690 |
| 2015/0116389 | A1* | 4/2015 | Watanabe ..... | G09G 3/3426 345/694 |

FOREIGN PATENT DOCUMENTS

| | | | |
|---|---|---|---|
| CN | 101669064 | A | 3/2010 |
| KR | 20120056634 | A | 6/2012 |

* cited by examiner

BACKLIGHT ADJUSTMENT METHOD, BACKLIGHT ADJUSTMENT SYSTEM AND DISPLAY DEVICE

FIELD OF THE INVENTION

The present invention relates to display technology, in particular to a backlight adjustment method, a backlight adjustment system and a display device.

BACKGROUND OF THE INVENTION

Liquid crystal display (LCD) has been widely used in modern information equipment due to its thin structure and the attribution of energy saving.

In order to reduce the overall power consumption of the liquid crystal display and increase the contrast, the backlight adjustment technique has been utilized in a liquid crystal display fields. At present, the LCD backlight is usually adjusted using the following backlight adjustment algorithm: a frame of picture is divided into n image blocks, the entire backlight region corresponding to the frame of the picture is also divided into n backlight sub-regions, the backlight brightness to be provided by each backlight sub-region when the frame is displayed is calculated depending on the overall display brightness of the plurality of pixels included in each image block (i.e., the so-called sub-backlight brightness of each backlight, the sub-backlight brightness is usually calculated by adding and averaging the display brightness of the plurality of pixels included in each image block). The sub-backlight brightness is supplied to each of the backlight sub-regions respectively, so as to provide a backlight giving different brightness for different regions when the frame of picture is displayed.

This backlight adjustment algorithm can reduce the overall power consumption of the LCD display, increase the contrast, and reduce influence of mura (a ripple phenomenon, that is, when the LCD display a full black screen, if the above adjustment algorithm is not used to adjust the backlight, then the screen has high brightness and the liquid crystal tends to aggregate in blocks under gravity, resulting in ripple phenomenon) on the screen, and can effectively improve the quality of the product. However, according to such adjustment algorithm, the brighter parts and darker parts in each image block are averaged to give a reduce display brightness of the image block, which leads to overall reduction of the brightness of a frame of picture, especially for such pictures which should have bright sense, the brightness is reduced obviously and thus the display quality is lowered.

SUMMARY OF THE INVENTION

The present invention is proposed in view of the above problems in the prior art, there is provided a backlight adjustment method, a backlight adjustment system and a display device. The backlight adjustment method not only solves the problems of reduced brightness for bright picture and poor display effect associated with existing backlight adjustment method, but also reduces the overall display power consumption, increase the image contrast and reduce influence of mura (ripple phenomenon) on the screen.

The present invention provides a backlight adjustment method, comprising: dividing a frame of picture into n image blocks, obtaining the sub-backlight brightness corresponding to each of said image blocks, and further comprising: calculating an average backlight brightness corresponding to the frame of the picture on the basis of each sub-backlight brightness, determining whether the sub-backlight brightness needs to be enhanced on the basis of the average backlight brightness, and performing enhancement for the sub-backlight brightness which needs to be enhanced, wherein n is an integer greater than 1.

Preferably, the step of determining on the basis of the average backlight brightness whether the sub-backlight brightness needs to be enhanced and performing enhancement for the sub-backlight brightness which needs to be enhanced comprises:

Determining whether the average backlight brightness is higher than a preset brightness, and if so, each of the sub-backlight brightness is enhanced, the frame of picture is provided with backlight using the enhanced sub-backlight brightness; if not, then the sub-backlight brightness is not enhanced.

Preferably, the step of determining whether the sub-backlight brightness needs to be enhanced on the basis of the average backlight brightness and performing enhancement for the sub-backlight brightness which needs to be enhanced comprises:

Determining whether the average backlight brightness is higher than a preset brightness, and if not, the frame of picture is provided with backlight using the sub-backlight brightness which is not enhanced; if the average backlight brightness is higher than a preset brightness, then it is further determined for each sub-backlight brightness whether the sub-backlight brightness is higher than the preset brightness, if so, the sub-backlight brightness is enhanced, and the corresponding image block is provided with backlight using the enhanced sub-backlight brightness; if the sub-backlight brightness is not higher than the preset brightness, the sub-backlight brightness is not enhanced.

Preferably, the entire backlight region corresponding to the frame of picture is divided into n backlight sub-regions, each of the image blocks corresponds to a backlight sub-region, the sub-backlight brightness is an average brightness of each backlight sub-region calculated depending on the display brightness of the plurality of pixels included in each image block, the average backlight brightness is an average brightness of the entire backlight region calculated depending on an average brightness of the backlight sub-regions.

Preferably, the enhancement value for enhancing the sub-backlight brightness is $T_B$ times of the average backlight brightness, wherein $T_B$ is a preset value for controlling the extent of enhancement.

Preferably, the method further comprises: converting the sub-backlight brightness which is enhanced or not enhanced into current signal and supplying said current signal to the backlight corresponding to the backlight sub-regions respectively.

The present invention also provides a backlight adjustment system comprising a signal source, an adjustment unit and a backlight, the system further comprises an enhancement unit, said signal source, adjustment unit, enhancement unit are in turn electrically connected to the backlight.

The signal source is used for providing at least a frame of picture, the frame of picture is divided into n image blocks, wherein n is an integer greater than 1.

The adjustment unit is used for obtaining the sub-backlight brightness corresponding to each of the image blocks, and calculating the average backlight brightness for the frame of picture on the basis of the sub-backlight brightness.

The enhancement unit is used for determining whether the sub-backlight brightness needs to be enhanced depending on the average backlight brightness, and enhancing the sub-backlight brightness which needs to be enhanced.

The backlight is used for providing backlighting for a frame of picture.

Preferably, the entire backlight region corresponding to the frame of picture is divided into n backlight sub-regions, each of the image blocks corresponds to a backlight sub-region; said adjustment unit includes a first calculation module and a second calculation module which are electrically connected.

The first calculation module is used for calculating the sub-backlight brightness, the sub-backlight brightness is an average brightness of each backlight sub-region calculated depending on the display brightness of the plurality of pixels included in each image block.

The second calculation module is used for calculating the average backlight brightness, the average backlight brightness is an average brightness of the entire backlight region calculated depending on an average brightness of the backlight sub-regions.

Preferably, the enhancement unit comprises a preset module, a first determination module and a third calculation module which are electrically connected.

The first determination module is used for determining whether the average backlight brightness is less than or equal to the preset brightness, and outputting the determination result.

The third calculating module is used for performing an enhancement calculation for the sub-backlight brightness depending on the determination result, the enhancement value is TB times of the average backlight brightness, wherein TB is a preset value for controlling the extent of enhancement.

The preset module is used for setting said preset brightness and TB.

Preferably, said enhancement unit further comprises a second determination module, said second determination module is connected electrically with the preset module, the first determination module and the third calculation module.

The second determination module is used for determining whether the sub-backlight brightness is higher than the preset brightness, and outputting the determination result.

The third calculation module is used for performing an enhancement calculation for the sub-backlight brightness depending on the determination result from the first and the second determination module.

Preferably, the system further comprises a conversion unit, the converting unit is connected electrically with the adjustment unit, the enhancement unit and the backlight, the conversion unit comprises a receiving module, a conversion module and a associating module electrically connected to each other.

The receiving module is used for receiving sub-backlight brightness which is enhanced or not enhanced based on the determination result from the first determination module or determination result from the first and second determination module.

The conversion module is used for converting the brightness signal received by the receiving module into a current signal and supplying the current signal to the backlight.

The associating module is used for associating each of the backlight sub-regions with the corresponding region address on the backlight.

Preferably, the adjustment unit and the enhancement unit are implemented using FPGA chip.

The present invention also provides a display device including the above backlight adjustment system.

The present invention provides the following advantageous effects:

The backlight adjustment method according to the present invention determines whether the sub-backlight brightness which needs to be enhanced based on the average backlight brightness, the sub-backlight brightness may be enhanced depending on the determination result and the frame of picture is provided with different backlight in different regions, such that when the overall display brightness of a frame of picture is comparatively dark (the average backlight brightness is less than or equal to the preset brightness), the backlight is provided with sub-backlight brightness which is not enhanced, and the display brightness and display effect can be ensured; on the other hand, when the overall display brightness of a frame of picture is comparatively bright (the average backlight brightness is higher than the preset brightness, or both the average backlight brightness and the sub-backlight brightness is higher than the preset brightness), the backlight is provided with enhanced sub-backlight brightness so as to enhance the display brightness and improve display effect of the bright picture. The above backlight adjustment method not only solves the problems of reduced brightness for bright picture and poor display effect associated with existing backlight adjustment method, but also reduces the overall display power consumption, increase the image contrast and reduce influence of mura (ripple phenomenon) on the screen.

The backlight adjustment system according to the present invention is provided with an enhancement unit, such that when the overall display brightness of a frame of picture is comparatively dark (the average backlight brightness is less than or equal to the preset brightness), the backlight is provided with sub-backlight brightness which is not enhanced, and the display brightness and display effect can be ensured; and when the overall display brightness of a frame of picture is comparatively bright (the average backlight brightness is higher than the preset brightness, or both the average backlight brightness and the sub-backlight brightness is higher than the preset brightness), the backlight is provided with enhanced sub-backlight brightness so as to enhance the display brightness and improve display effect of the bright picture. By means of the enhancement unit, the backlight adjustment system not only solves the problems of reduced brightness for bright picture and poor display effect associated with existing backlight adjustment system, but also reduces the overall display power consumption, increase the image contrast and reduce influence of mura (ripple phenomenon) on the screen.

The display device according to the present invention comprises the above-mentioned backlight adjustment system, such that the brightness of the display device is increased, the display effect is improved, and the overall display power consumption of the display device can be reduced.

REFERENCE NUMERALS

1. signal source; 2. adjustment unit; 21. first calculation module; 22. second calculation module; 3. enhancement unit; 31. preset module; 32. first determination module; 33. second determination module; 34. third calculation module; 4. backlight; 5. conversion unit; 51. receiving module; 52. conversion module; 53. association module.

DETAILED DESCRIPTION OF THE EMBODIMENTS

To make those skilled in the art better understand the technical solution of the present invention, the backlight adjustment method, backlight adjustment system and display device will be further described in detail with reference to the accompanying drawings and the embodiments of the present invention.

Embodiment 1

Figure 1:
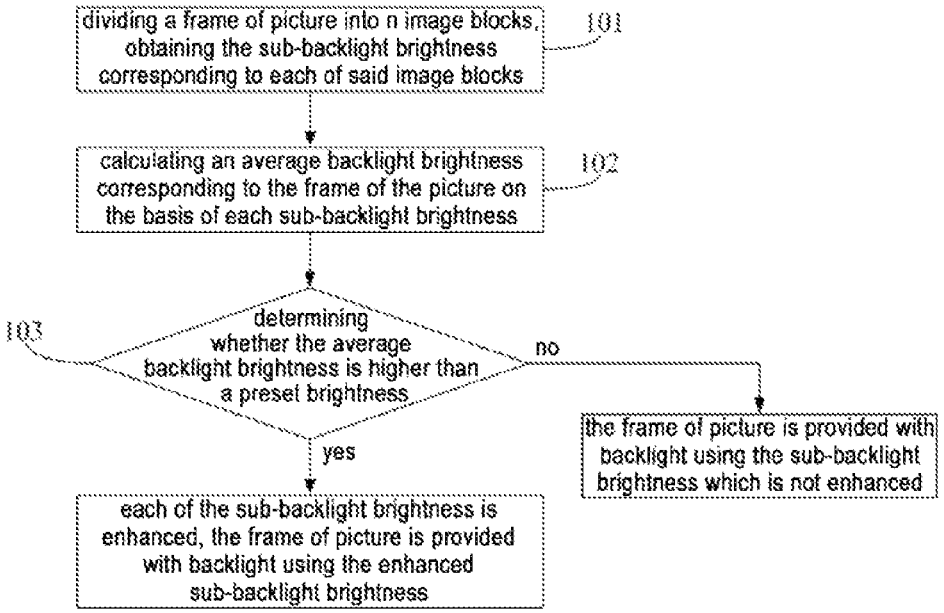
FIG. 1 is a flowchart showing the backlight adjustment method according to embodiment 1 of the present invention.

The present embodiment provides a backlight adjustment method, as shown in FIG. 1, the method comprises Step 101: dividing a frame of picture into n image blocks, obtaining the sub-backlight brightness corresponding to each of said image blocks, wherein n is an integer greater than 1.

In this step, the entire area of the backlight corresponding to the frame of picture area is divided into n backlight sub-regions, each of the image blocks corresponds to a backlight sub-region. The sub-backlight brightness is an average brightness of each backlight sub-region calculated depending on the display brightness of the plurality of pixels included in each image block. The sub-backlight brightness may be calculated using the following formula:

$$Lin(n) = \frac{T_L}{P_{NUM}} \sum [Hn(i) \cdot W(i)] \tag{1}$$

In Formula (1), Lin (n) is the average brightness of the n-th backlight sub-region among the plurality of backlight sub-regions, i.e. the sub-backlight brightness for the n-th backlight sub-region. $T_L$ is a preset value for controlling brightness, which can be manually adjusted by the user on the display device; $P_{NUM}$ is the number of pixels for displaying the n-th image block; Hn(i) is the brightness value of the i-th pixel among the pixels for displaying the n-th image block; W(i) is a preset weight vector for the i-th pixel (i.e. the weighting factor for determining the gray scale value of the i-th pixel).

Step 102: Calculate an average backlight brightness corresponding to the frame of the picture on the basis of each sub-backlight brightness.

In this step, the average backlight brightness is an average brightness of the entire backlight region calculated depending on an average brightness of the backlight sub-regions. The average backlight brightness may be calculated using the following formula:

$$Lin_{average} = \frac{1}{n} \sum Lin(n) \tag{2}$$

In Formula (2), n is the total number of the backlight sub-regions corresponding to the frame of picture, and is also the number of the divided image blocks within the frame of picture; $Lin_{average}$ is the calculated average brightness of the entire backlight region, that is, the average backlight brightness.

The backlight adjustment method of this embodiment further comprises step 103: determining on the basis of the average backlight brightness whether the sub-backlight brightness needs to be enhanced, performing enhancement for the sub-backlight brightness according to the determination result and provide different backlight brightness for different regions on the frame of picture. Step 103 specifically comprises: determining whether the average backlight brightness is higher than a preset brightness, and if so, each of the sub-backlight brightness is enhanced, the frame of picture is provided with backlight using the enhanced sub-backlight brightness; if not, then the sub-backlight brightness is not enhanced. The preset brightness may be set in advance based on the display brightness of the frame of picture.

In this step, the enhancement value for enhancing the sub-backlight brightness is $T_B$ times of the average backlight brightness, wherein $T_B$ is a preset value for controlling the extent of enhancement. The formula for calculating the enhanced backlight brightness is:

$$L_{enhanced} = Lin(n) + T_B \cdot Lin_{average} \tag{3}$$

In Formula (3), $L_{enhanced}$ is the enhanced subbacklight brightness. Note that the n enhanced subbacklight brightness are provided respectively for n corresponding backlight sub-regions. The enhancement value for each subbacklight brightness is the same, wherein $T_B$ is adjustable. Of course, if the sub-backlight brightness is not higher than the preset brightness, none of the sub-backlight brightness is enhanced.

The backlight is adjusted such that when the overall display brightness of a frame of picture is comparatively dark (the average backlight brightness is less than or equal to the preset brightness), the backlight is provided with sub-backlight brightness Lin (n) which is not enhanced, and the display brightness and display effect can be ensured; on the other hand, when the overall display brightness of a frame of picture is comparatively bright (the average backlight brightness is higher than the preset brightness), the backlight is provided with enhanced sub-backlight brightness ($L_{enhanced}$) so as to enhance the display brightness and improve display effect of the bright picture. The above backlight adjustment method not only solves the problems of reduced brightness for bright picture and poor display effect associated with existing backlight adjustment method, but also reduces the overall display power consumption, increase the image contrast and reduce influence of mura (ripple phenomenon) on the screen.

In the present embodiment, the backlight adjustment method further comprises: converting the sub-backlight brightness which is enhanced or not enhanced into current signal and supplying said current signal to the backlight corresponding to the respective backlight sub-regions. The backlight (e.g. LED) typically requires current signal, therefore the adjusted brightness signal should be firstly converted into current signal and then supplied to the backlight. The current signals for the n backlight sub-regions should be provided to the backlight for the respective backlight sub-regions correspondingly, so as to ensure proper display of a frame of picture.

Embodiment 2

Figure 2:
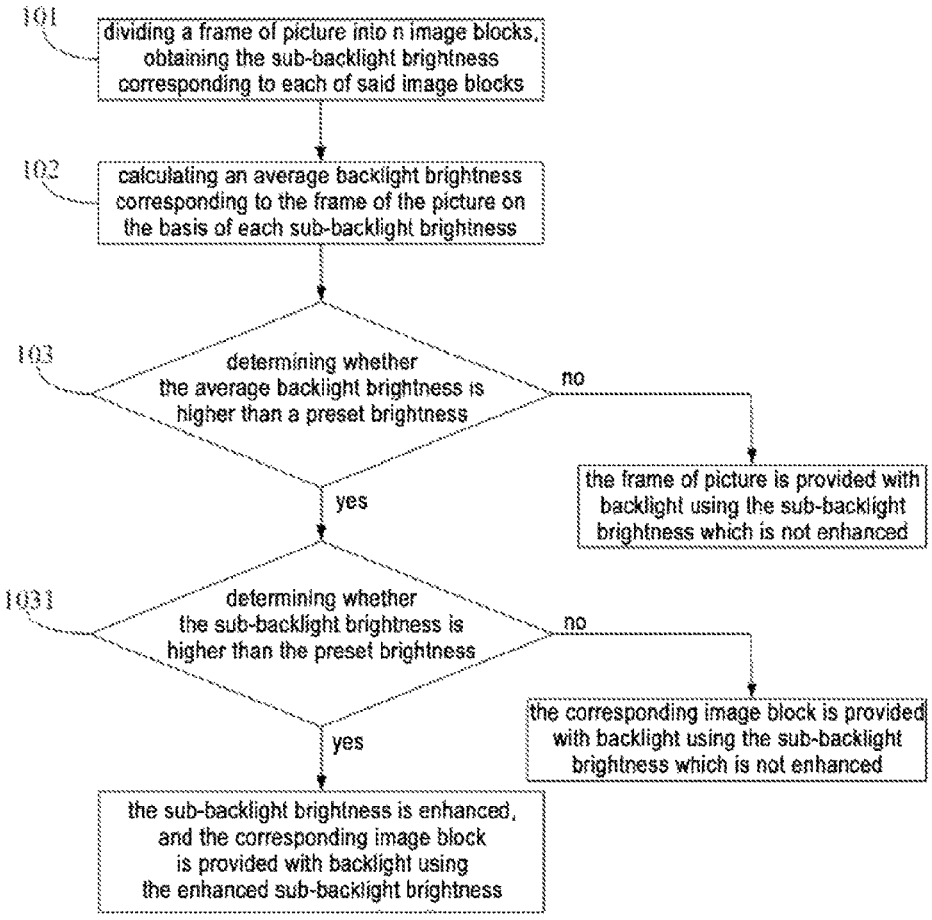
FIG. 2 is a flowchart showing the backlight adjustment method according to embodiment 2 of the present invention.

The present embodiment provides a backlight adjustment method, and is different from Embodiment 1 in that: as shown in FIG. 2, in step 103, it is determined whether the average backlight brightness is higher than the preset brightness, and if yes, step 1031 is further performed: determining for each sub-backlight brightness whether the sub-backlight brightness is higher than the preset brightness, if so, the sub-backlight brightness is enhanced, and the corresponding image block is provided with backlight using the enhanced sub-backlight brightness; if the sub-backlight brightness is not higher than the preset brightness, the corresponding image block is provided with backlight using the sub-backlight brightness which is not enhanced.

In other words, if the average backlight brightness is higher than the preset brightness, each of the sub-backlight brightness is further compared with the preset brightness, those sub-backlight brightness higher than the preset brightness is enhanced and the enhanced sub-backlight brightness is provided to the corresponding image block. The sub-backlight brightness less than or equal to the preset brightness is not enhanced, the corresponding image block is provided with sub-backlight brightness which is not enhanced.

That is, for one frame of bright picture (i.e., the average backlight brightness is higher than the preset brightness), only those regions having sub-backlight brightness higher than certain brightness value are to be enhanced, the dark regions (wherein the sub-backlight brightness is less than or equal to certain brightness value) on the bright picture are not to be enhanced. The backlight is thus adjusted such that further enhance the sub-backlight brightness for the backlight sub-regions corresponding to bright image blocks are further enhanced, while the sub-backlight brightness for dark image blocks are maintained, therefore the contrast of the display screen can be enhanced and the display effect is improved.

Other steps in the backlight adjustment method of the present embodiment are the same as those in Embodiment 1, the detailed description is omitted here.

The backlight is thus adjusted such that when the overall display brightness of a frame of picture is comparatively dark (the average backlight brightness is less than or equal to the preset brightness), the backlight is provided with sub-backlight brightness Lin(n) which is not enhanced, and the display brightness and display effect can be ensured; when the overall display brightness of a frame of picture is comparatively bright (the average backlight brightness is higher than the preset brightness and the sub-backlight brightness is higher than the preset brightness), the backlight is provided with enhanced sub-backlight brightness ($L_{enhanced}$) so as to enhance the display brightness and improve display effect of the bright picture. The above backlight adjustment method not only solves the problems of reduced brightness for bright picture and poor display effect associated with existing backlight adjustment method, but also reduces the overall display power consumption, increase the image contrast and reduce influence of mura (ripple phenomenon) on the screen.

Embodiment 3

Figure 3:
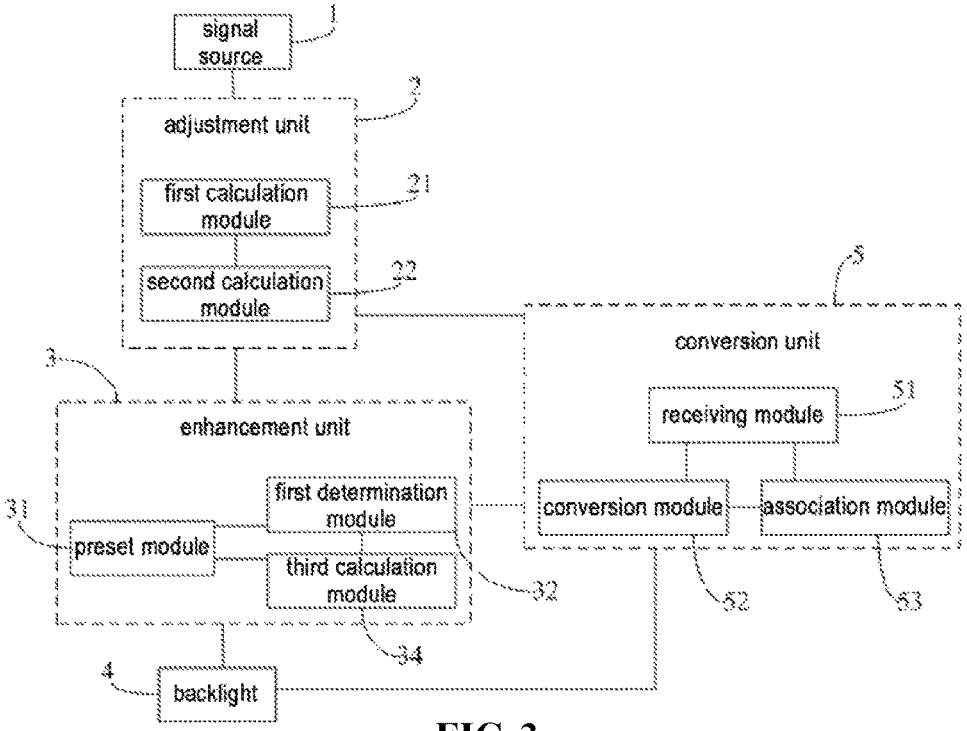
FIG. 3 is a block diagram showing the principle of the backlight adjustment system according to embodiment 3 of the present invention.

The present embodiment provides a backlight adjustment system, as shown in FIG. 3, the backlight adjustment system comprises a signal source 1, an adjustment unit 2 and a backlight 4, the system further comprises an enhancement unit 3, said signal source 1, adjustment unit 2, enhancement unit 3 are in turn electrically connected to the backlight 4. The signal source 1 is used for providing at least a frame of picture, the frame of picture is divided into n image blocks, wherein n is an integer greater than 1. The adjustment unit 2 is used for obtaining the sub-backlight brightness corresponding to each of the image blocks, and calculating the average backlight brightness for the frame of picture on the basis of the sub-backlight brightness. The enhancement unit 3 is used for determining whether the sub-backlight brightness needs to be enhanced depending on the average backlight brightness, enhancing the sub-backlight brightness based on the determination result and providing different backlight for different regions on the frame of picture. The backlight 4 is used for providing backlighting for a frame of picture. The preset brightness can be set in advance based on the display brightness of the frame of picture.

In the present embodiment, the entire backlight region corresponding to the frame of picture is divided into n backlight sub-regions, each of the image blocks corresponds to a backlight sub-region; said adjustment unit 2 includes a first calculation module 21 and the second calculation module 22 which are electrically connected. The first calculation module 21 is used for calculating the sub-backlight brightness, the sub-backlight brightness is an average brightness of each backlight sub-region calculated depending on the display brightness of the plurality of pixels included in each image block. The second calculation module 22 is used for calculating the average backlight brightness, the average backlight brightness is an average brightness of the entire backlight region calculated depending on an average brightness of the backlight sub-regions.

In the present embodiment, the enhancement unit 3 comprises a preset module 31, a first determination module 32 and a third calculation module 34 which are electrically connected. The first determination module 32 is used for determining whether the average backlight brightness is less than or equal to the preset brightness, and outputting the determination result. The third calculating module 34 is used for performing an enhancement calculation for the sub-backlight brightness depending on the determination result from the first determination module 32, the enhancement value is $T_B$ times of the average backlight brightness, wherein $T_B$ is a preset value for controlling the extent of enhancement. The preset module 31 is used for setting the preset brightness and $T_B$, the preset brightness and $T_B$ can be manually set.

By using the enhancement unit 3, when the overall display brightness of a frame of picture is comparatively bright, the sub-backlight brightness of all the backlight sub-regions on the frame of picture is enhanced, such that the overall brightness of bright picture can be further enhanced and the display effect is improved.

The adjustment unit 2 and the enhancement unit 3 are implemented using FPGA chip. The function of backlight adjustment calculation for backlight in the adjustment unit 2 and the enhancement unit 3 is implemented by setting of logical circuit.

In the present embodiment, the backlight adjustment system further comprising a conversion unit 5, the converting unit 5 is connected electrically with the adjustment unit 2, the enhancement unit 3 and the backlight 4, the conversion unit 5 comprises a receiving module 51, a conversion module 52 and a associating module 53 electrically connected with each other. The receiving module 51 is used for receiving sub-backlight brightness which is enhanced or not enhanced based on the determination result from the first determination module 32. The conversion module 52 is used for converting the brightness signal received by the receiving module 51 into a current signal and supplying the current signal to the backlight 4. The associating module 53 is used for associating each of the backlight sub-regions with the corresponding region address on the backlight 4.

By means of the conversion unit 5, on one hand, the signal of backlight brightness corresponding to a frame of picture obtained by calculation of the adjustment unit 2 or the enhancement unit 3 is converted into current signal (that is, the brightness signal and the backlight driving signal are matched in signal format), so as to be supplied to the backlight 4; on the other hand, the brightness signal of each backlight sub-region corresponding to a frame of picture obtained by calculation of the adjustment unit 2 or the enhancement unit 3 is assigned to the backlight 4 for the respective backlight sub-regions correspondingly (i.e. associating the signal with the backlight sub-regions in region address), so as to ensure proper display of a frame of picture.

The backlight adjustment system according to the present invention is provided with an enhancement unit, such that when the overall display brightness of a frame of picture is comparatively dark (the average backlight brightness is less than or equal to the preset brightness), the backlight is provided with sub-backlight brightness which is not enhanced, and the display brightness and display effect can be ensured; and when the overall display brightness of a frame of picture is comparatively bright (the average backlight brightness is higher than the preset brightness), the backlight is provided with enhanced sub-backlight brightness so as to enhance the display brightness and improve display effect of the bright picture.

Embodiment 4

Figure 4:
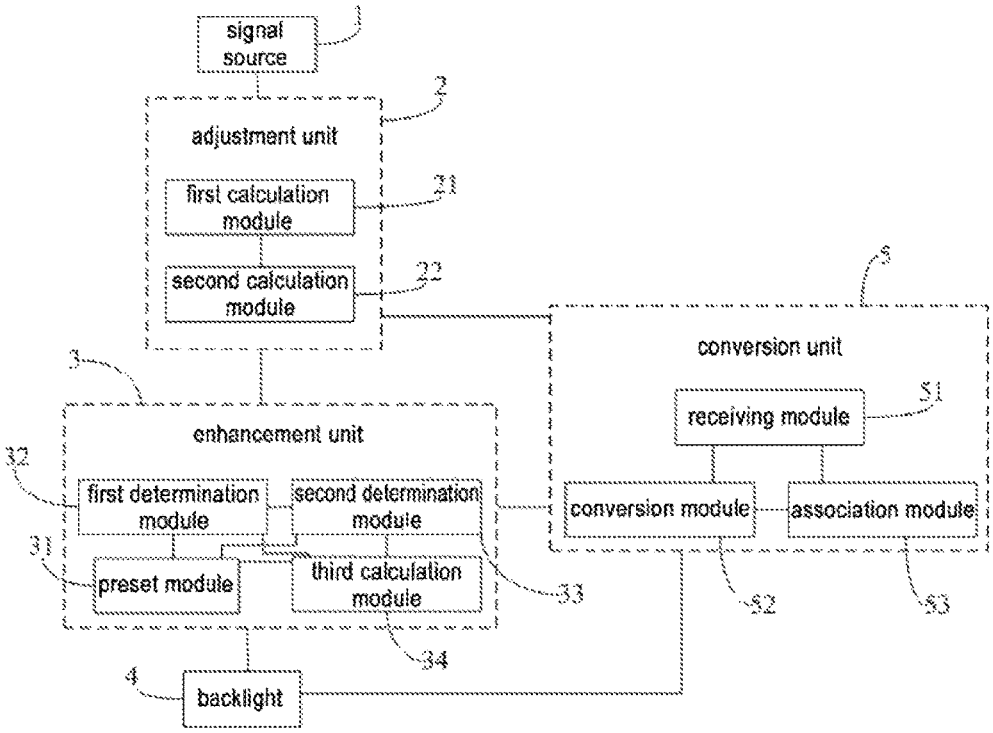
FIG. 4 is a block diagram showing the principle of the backlight adjustment system according to embodiment 4 of the present invention.

The present embodiment provides a backlight adjustment system differs from the third embodiment in that, as shown in FIG. 4, on the basis of Embodiment 3, the enhancement unit 3 further comprises a second determination module 33, the second determination module 33 is connected electrically with the preset module 31, the first determination module 32 and the third calculation module 34. The second determination module 33 is used for determining whether the sub-backlight brightness is higher than the preset brightness, and outputting the determination result. The third calculation module 34 is used for performing an enhancement calculation for the sub-backlight brightness depending on the determination result from the first determination module 32 and the second determination module 33.

Accordingly, the receiving module 51 is used for receiving sub-backlight brightness which is enhanced or not enhanced based on the determination result from the first determination module 32 and the determination result from the second determination module 33.

The backlight adjustment system according to the present invention is provided with an enhancement unit, such that when the overall display brightness of a frame of picture is comparatively dark (the average backlight brightness is less than or equal to the preset brightness), the backlight is provided with sub-backlight brightness which is not enhanced, and the display brightness and display effect can be ensured; and when the overall display brightness of a frame of picture is comparatively bright (the average backlight brightness is higher than the preset brightness and the sub-backlight brightness is higher than the preset brightness), the backlight is provided with enhanced sub-backlight brightness so as to enhance the display brightness and improve display effect of the bright picture.

By means of the enhancement unit in Embodiments 3-4, the backlight adjustment system not only solves the problems of reduced brightness for bright picture and poor display effect associated with existing backlight adjustment system, but also reduces the overall display power consumption, increase the image contrast and reduce influence of mura (ripple phenomenon) on the screen.

Embodiment 5

This embodiment provides a display device comprising the backlight adjustment system of any one of Embodiments 3-4.

By using the backlight adjustment system of any one of Embodiments 3-4, the brightness of the display device is increased, the display effect of the display device is improved, and the overall display power consumption of the display device can be reduced.

It could be understood that, the above implementations are merely exemplary implementations for illustrating the principle of the present invention, the present invention is not limited hereto. Various modifications and improvements could be made for those of ordinary skill in the art without departing from the spirit and essence of the present invention, and these modifications and improvements may be encompassed within the protection scope of the present invention.

The invention claimed is:

1. A backlight adjustment method, comprising:

dividing a frame of picture into n image blocks, wherein n is an integer greater than 1;

obtaining a sub-backlight brightness corresponding to each of said image blocks;

calculating an average backlight brightness corresponding to the frame of the picture on the basis of all of the sub-backlight brightness;

determining whether the average backlight brightness is higher than a preset threshold, in response to the average backlight brightness being higher than the preset threshold, each sub-backlight brightness is enhanced by adding a same enhancement value to a value of the sub-backlight brightness, wherein the enhancement value is TB times of the average backlight brightness, wherein TB is a preset value for controlling the extent of enhancement, and the frame of picture is provided with backlight using the enhanced sub-backlight brightness; and in response to the average backlight brightness being not higher than the preset threshold, the sub-backlight brightness is not enhanced, and wherein said enhancement refers to increasing the sub-backlight brightness.

2. The backlight adjustment method of claim 1, wherein the entire backlight region corresponding to the frame of picture is divided into n backlight sub-regions, each of the image blocks corresponds to a backlight sub-region, the sub-backlight brightness is an average brightness of each backlight sub-region calculated depending on the display brightness of the plurality of pixels included in each image block, the average backlight brightness is an average brightness of the entire backlight region calculated depending on an average brightness of the backlight sub-regions.

3. The backlight adjustment method of claim 1, wherein the method further comprises: converting the sub-backlight brightness which is enhanced or not enhanced into a current signal, and supplying the current signal to the backlight corresponding to the backlight sub-regions respectively.

4. A backlight adjustment method, comprising:

dividing a frame of picture into n image blocks, wherein n is an integer greater than 1;

obtaining a sub-backlight brightness corresponding to each of said image blocks;

calculating an average backlight brightness corresponding to the frame of the picture on the basis of all of the sub-backlight brightness;

determining whether the average backlight brightness is higher than a preset threshold, in response to the average backlight brightness being not higher than the preset threshold, the frame of picture is provided with backlight using the sub-backlight brightness which is not enhanced; and in response to the average backlight brightness being higher than the preset brightness, it is further determined for each sub-backlight brightness whether the sub-backlight brightness is higher than the preset brightness, in response to the sub-backlight brightness being higher than the preset brightness, the sub-backlight brightness is enhanced by adding a same enhancement value to a value of the sub-backlight brightness, wherein the enhancement value is TB times of the average backlight brightness, wherein TB is a preset value for controlling the extent of enhancement, and the corresponding image block is provided with backlight using the enhanced sub-backlight brightness; and in response to the sub-backlight brightness being not higher than the preset brightness, the sub-backlight brightness is not enhanced.

5. A backlight adjustment system, comprising a signal source, an adjustment unit and a backlight; wherein the system further comprises an enhancement unit; the signal source, the adjustment unit and the enhancement unit are in turn electrically connected to the backlight, wherein the signal source is used for providing a frame of picture, the frame of picture is divided into n image blocks, wherein n is an integer greater than 1;

the backlight is used for providing backlighting for the frame of picture;

the adjustment unit is used for obtaining a sub-backlight brightness corresponding to each of the image blocks, and calculating an average backlight brightness for the frame of picture on the basis of all of the sub-backlight brightness; and the enhancement unit is used for determining whether the average backlight brightness is higher than a preset brightness, in response to the average backlight brightness being higher than the preset brightness, each sub-backlight brightness is enhanced by adding a same enhancement value to a value of the sub-backlight brightness, wherein the enhancement value is TB times of the average backlight brightness, wherein TB is a preset value for controlling the extent of enhancement, and the frame of picture is provided with backlight using the enhanced sub-backlight brightness;

and in response to the average backlight brightness being not higher than the preset brightness, the sub-backlight brightness is not enhanced.

6. The backlight adjustment system of claim 5, wherein the entire backlight region corresponding to the frame of picture is divided into n backlight sub-regions, each of the image blocks corresponds to a backlight sub-region; the adjustment unit includes a first calculation module and a second calculation module which are electrically connected with each other;

the first calculation module is used for calculating the sub-backlight brightness, the sub-backlight brightness is an average brightness of each backlight sub-region calculated depending on the display brightness of the plurality of pixels included in each image block;

the second calculation module is used for calculating the average backlight brightness, the average backlight brightness is an average brightness of the entire backlight region calculated depending on an average brightness of the backlight sub-regions.

7. The backlight adjustment system of claim 6, wherein the enhancement unit comprises a preset module, a first determination module and a third calculation module which are electrically connected;

the first determination module is used for determining whether the average backlight brightness is less than or equal to the preset brightness, and outputting the determination result;

the third calculating module is used for performing an enhancement calculation for the sub-backlight brightness depending on the determination result; and the preset module is used for setting said preset brightness and $T_B$.

8. The backlight adjustment system of claim 7, wherein the enhancement unit further comprises a second determination module, said second determination module is connected electrically with the preset module, the first determination module and the third calculation module;

the second determination module is used for determining whether the sub-backlight brightness is higher than the preset brightness, and outputting the determination result;

the third calculation module is used for performing an enhancement calculation for the sub-backlight brightness depending on the determination result from the first and the second determination module.

9. The backlight adjustment system of claim 8, wherein the system further comprises a conversion unit; the converting unit is connected electrically with the adjustment unit, the enhancement unit and the backlight, the conversion unit comprises a receiving module, a conversion module and an associating module electrically connected with each other;

the receiving module is used for receiving sub-backlight brightness which is enhanced or not enhanced based on the determination result from the first determination module or determination result from the first and second determination module;

the conversion module is used for converting the brightness signal received by the receiving module into a current signal and supplying the current signal to the backlight;

the associating module is used for associating each of the backlight sub-regions with the corresponding region address on the backlight.

10. The backlight adjustment system of claim 5, wherein the adjustment unit and the enhancement unit are implemented using FPGA chip.

11. A display device comprising a backlight adjustment system, the backlight adjustment system comprises a signal source, an adjustment unit and a backlight; wherein the system further comprises an enhancement unit; the signal source, the adjustment unit and the enhancement unit are in turn electrically connected to the backlight, wherein the signal source is used for providing a frame of picture, the frame of picture is divided into n image blocks, wherein n is an integer greater than 1;

the backlight is used for providing backlighting for the frame of picture;

the adjustment unit is used for obtaining a sub-backlight brightness corresponding to each of the image blocks, and calculating an average backlight brightness for the frame of picture on the basis of all of the sub-backlight brightness;

the enhancement unit is used for determining whether the average backlight brightness is higher than a preset brightness, in response to the average backlight brightness being higher than the present brightness, each sub-backlight brightness is enhanced by adding a same enhancement value to a value of the sub-backlight brightness, wherein the enhancement value is TB times of the average backlight brightness, wherein TB is a preset value for controlling the extent of enhancement, and the frame of picture is provided with backlight using the enhanced sub-backlight brightness;

and in response to the average backlight brightness being not higher than the preset brightness, the sub-backlight brightness is not enhanced.

12. The display device of claim 11, wherein the entire backlight region corresponding to the frame of picture is divided into n backlight sub-regions, each of the image blocks corresponds to a backlight sub-region; the adjustment unit includes a first calculation module and a second calculation module which are electrically connected with each other;

the first calculation module is used for calculating the sub-backlight brightness, the sub-backlight brightness is an average brightness of each backlight sub-region calculated depending on the display brightness of the plurality of pixels included in each image block;

the second calculation module is used for calculating the average backlight brightness, the average backlight brightness is an average brightness of the entire backlight region calculated depending on an average brightness of the backlight sub-regions.

13. The display device of claim 12, wherein the enhancement unit comprises a preset module, a first determination module and a third calculation module which are electrically connected;

the first determination module is used for determining whether the average backlight brightness is less than or equal to the preset brightness, and outputting the determination result;

the third calculating module is used for performing an enhancement calculation for the sub-backlight brightness depending on the determination result; and the preset module is used for setting said preset brightness and $T_B$.

14. The display device of claim 13, wherein the enhancement unit further comprises a second determination module, said second determination module is connected electrically with the preset module, the first determination module and the third calculation module;

the second determination module is used for determining whether the sub-backlight brightness is higher than the preset brightness, and outputting the determination result;

the third calculation module is used for performing an enhancement calculation for the sub-backlight brightness depending on the determination result from the first and the second determination module.

15. The display device of claim 14, wherein the system further comprises a conversion unit, the converting unit is connected electrically with the adjustment unit, the enhancement unit and the backlight, the conversion unit comprises a receiving module, a conversion module and a associating module electrically connected with each other;

the receiving module is used for receiving sub-backlight brightness which is enhanced or not enhanced based on the determination result from the first determination module or determination result from the first and second determination module;

the conversion module is used for converting the brightness signal received by the receiving module into a current signal and supplying the current signal to the backlight;

the associating module is used for associating each of the backlight sub-regions with the corresponding region address on the backlight.

16. The display device of claim 11, wherein the adjustment unit and the enhancement unit are implemented using FPGA chip.

* * * * *